US005437548A

United States Patent [19]

Katchka

[11] Patent Number: 5,437,548

[45] Date of Patent: * Aug. 1, 1995

[54] FUEL IGNITION SYSTEM AND METHOD OF MAKING THE SAME

[75] Inventor: Jay R. Katchka, Cypress, Calif.

[73] Assignee: Robertshaw Controls Company, Richmond, Va.

[ * ] Notice: The portion of the term of this patent subsequent to May 24, 2011 has been disclaimed.

[21] Appl. No.: 230,728

[22] Filed: Apr. 21, 1994

Related U.S. Application Data

[62] Division of Ser. No. 5,590, Jan. 19, 1993, Pat. No. 5,314,328.

[51] Int. Cl.[6] ..... F23N 5/00

[52] U.S. Cl. ..... 431/66

[58] Field of Search ..... 431/66

[56] References Cited

U.S. PATENT DOCUMENTS 4,053,136 10/1977 Perl ..... 251/11

4,188,181 2/1980 Rippelmeyer et al. ..... 431/66

4,560,343 12/1985 Bohan ..... 431/66

*Primary Examiner*—Carroll B. Dority

*Attorney, Agent, or Firm*—Candor, Candor & Tassone

[57] ABSTRACT

A fuel ignition system and method of making the same are provided, the system having a unit for detecting when an igniter has been heated to ignition temperature, the detecting unit comprising a receiving member for receiving at least some of the electrons emitted from the heated igniter and an electrical circuit for determining from the received electrons an emission rate of the electrons and for operating a fuel feeding device to feed fuel to a burner only when the determined emission rate is at a certain level that proves that the igniter is at ignition temperature.

12 Claims, 1 Drawing Sheet

FUEL IGNITION SYSTEM AND METHOD OF MAKING THE SAME

CROSS REFERENCE TO RELATED APPLICATIONS

This application is a divisional patent application of its parent U.S. patent application, Ser. No. 08/005,590 filed Jan. 19, 1993 and now U.S. Pat. No. 5,314,328.

BACKGROUND OF THE INVENTION

1. Field of the Invention

This invention relates to a new ignition system for a burner means and to a new method of making such a fuel ignition system.

2. Prior Art Statement

It is known to provide a fuel ignition system for a burner means comprising an igniter, means for heating the igniter to ignition temperature thereof whereby the igniter emits electrons therefrom in relation to the temperature thereof, feeding means for feeding fuel from a source thereof to the burner means, and detecting means for detecting the condition of the igniter and being operatively associated with the feeding means to feed fuel to the burner means only when the detecting means detects that the igniter is at ignition temperature. For example, see Perl the U.S. Pat. No. 4,053,136 which disposes a silicon carbide igniter in series with the heat motor of a gas feeding valve so that as the igniter reaches ignition temperature, the resistance to current flow therethrough decreases whereby the current flow through the electrical heater means of the gas valve increases to increase the output temperature thereof to open the gas valve when the igniter is at ignition temperature.

It was found according to the teachings of this invention that the silicon carbide igniter utilized in the prior known ignition system actually emits electrons with the rate of emission of the electrons increasing as the temperature of the igniter increases. However, it is applicant's belief that such emission of electrons has never been used to determine when the igniter is at ignition temperature.

It is also known that a diode tube has a cathode therein which when heated will emit electrons which can be collected by a plate disposed spaced therefrom so as to develop a DC voltage that has a magnitude that is in relation to the amount of electrons being emitted by the cathode. For example, see pages 472–479 of the second edition of *Basic Electronics* authored by Bernard Grob and published by the McGraw-Hill Book Company with Copyright dates of 1959 and 1965 therein.

SUMMARY OF THE INVENTION

It is one of the features of this invention to provide a new fuel ignition system wherein unique means are provided for detecting when the igniter thereof is at ignition temperature.

In particular, it was found according to the teachings of this invention that since an igniter emits electrons therefrom in relation to the temperature thereof, a receiving means can be disposed adjacent the igniter to receive at least some of the emitted electrons so that a determining means operatively associated with the receiving means can determine from the received electrons an emission rate of the electrons from the igniter so as to operate a fuel feeding means to feed fuel to a burner only when the determined emission rate is at a certain level that proves that the igniter is at ignition temperature.

For example, one embodiment of this invention comprises a fuel ignition system for a burner means comprising an igniter, means for heating the igniter to ignition temperature thereof whereby the igniter emits electrons therefrom in relation to the temperature thereof, feeding means for feeding fuel from a source thereof to the burner means, and detecting means for detecting the condition of the igniter and being operatively associated with the feeding means to feed fuel to the burner means only when the detecting means detects that the igniter is at ignition temperature, the detecting means comprising receiving means for receiving at least some of the emitted electrons, determining means operatively associated with the receiving means for determining from the received electrons an emission rate of the electrons from the igniter, and operating means operatively associated with the determining means for operating the feeding means to feed the fuel only when the determined emission rate is at a certain level.

Accordingly, it is an object of this invention to provide a new fuel ignition system for a burner means, the system of this invention having one or more of the novel features of this invention as set forth above or hereinafter shown or described.

Another object of this invention is to provide a new method of making such a fuel ignition system for a burner means, the method of this invention having one or more of the novel features of this invention as set forth above or hereinafter shown or described.

Other objects, uses and advantages of this invention are apparent from a reading of this description which proceeds with reference to the accompanying drawings forming a part thereof and where in:

DESCRIPTION OF THE PREFERRED EMBODIMENT

Figure 1:
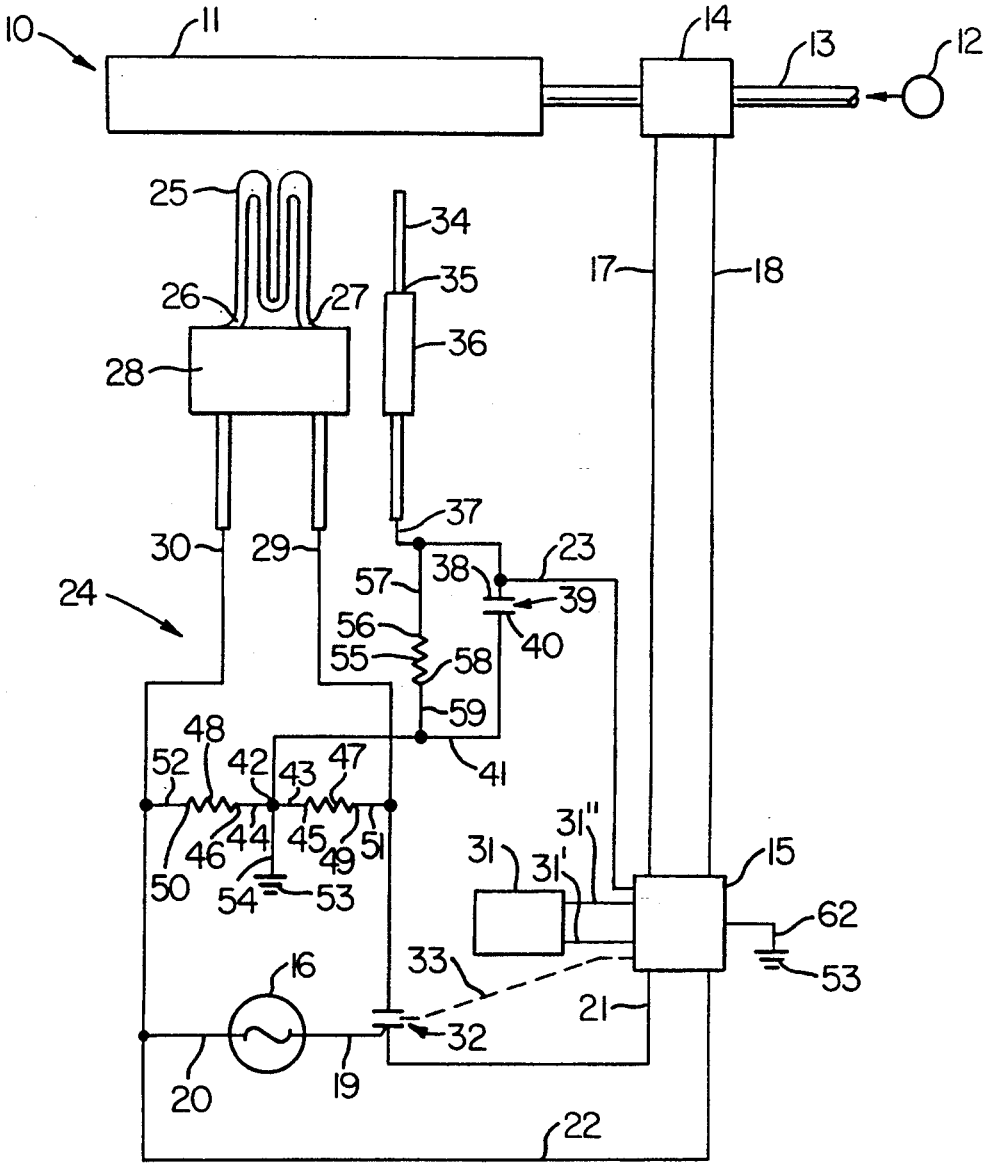
FIG. 1 is a schematic view illustrating the new fuel ignition system of this invention.

While the various features of this invention are hereinafter illustrated and described as being particularly adapted to provide a fuel ignition system utilizing a particular igniter, it is to be understood that the various features of this invention can be utilized singly or in various combinations thereof to provide fuel ignition systems utilizing other types of igniters as desired.

Therefore, this invention is not to be limited to only the embodiment illustrated in the drawings, because the drawings are merely utilized to illustrate one of the wide variety of uses of this invention.

Figure 2:
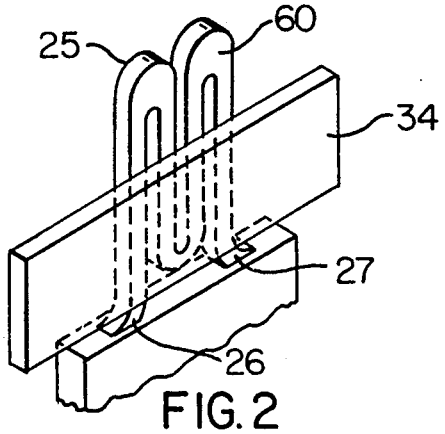
FIG. 2 is a fragmentary perspective view of the igniter and collecting plate of this invention utilized in the system of FIG. 1.

Referring now to FIGS. 1 and 2, the new fuel ignition system of this invention is generally indicated by the reference numeral 10 and comprises a conventional burner means 11 being adapted to receive fuel from a fuel source 12 through an interconnecting conduit means 13 when a fuel feeding means 14 disposed in the conduit means 13 is in an open condition, the fuel feeding means 14 comprising an electrically operated valve means which is electrically operated to the open condition thereof when an operating means or control device 15 of the system 10 interconnects an electrical power source 16 thereto through lead means 17 and 18. The operating means 15 closes the valve means 14 by disconnecting the power source 16 therefrom in a manner well known in the art whereby the closed valve means 14 terminates the flow of fuel to the burner means 11.

For example, see the aforementioned Perl U.S. Pat. No. 4,053,136 and the Geary U.S. Pat. Nos. 4,711,628 and 4,809,128 whereby these three U.S. patents are being incorporated into this disclosure by this reference thereto.

The control device 15 is interconnected to power source lead means 19 and 20 of the electrical power source 16 by lead means 21 and 22. When the control device 15 receives a DC voltage signal of a certain magnitude as determined by signal means from the lead means 21 and a lead means 23 that is interconnected to the control device 15 and to an electrical circuit means that is generally indicated by the reference numeral 24 in FIG. 1 and comprising part of the system 10 as illustrated, the control device 15 interconnects the power source leads 21 and 22 to the leads 17 and 18 that are interconnected to the fuel feeding valve means 14. For example, the DC voltage signal of the control device can trigger an electronic device, such as an SCR, a field effect transistor, etc. when the magnitude of the DC voltage signal reaches a certain value and the triggered electronic device (not shown) in the control device 15 interconnects the power source lead means 21 and 22 to the lead means 17 and 18 in a manner well known in the art.

The system 10 comprises an igniter or hot surface means 25 that is formed from silicon carbide and is shaped in the configuration of an upside-down W with the opposed ends or legs 26 and 27 thereof interconnected by an insulating terminal block means 28 to lead means 29 and 30 that are respectively interconnected to the power source leads 19 and 20 as illustrated in FIG. 1. In this manner, the power source 16, which comprises an alternating current power source having any suitable voltage, such as 120 volts, can be interconnected to the lead means 29 and 30 when the control means 15, under the control of a conventional thermostat 31 of the circuit means 24, closes a switch means 32 disposed in the lead means 29 and interconnected to the control means 15 by operating means 33. Thus, an alternating current from the source 16 is adapted to pass through the igniter 25 and heat up the same in a manner well known in the art. For example, see the aforementioned Geary U.S. Pat. No. 4,809,128 wherein the same describes utilizing a 120 volt rated Norton igniter No. 201 of the Norton Company, Worcester, Mass., 01606 of the same type and configuration as the igniter 25 illustrated in FIGS. 1 and 2.

As previously stated, it has been found according to the teachings of this invention that as the silicon carbide igniter 25 increases in temperature as the electrical current is being continuously passed therethrough from the electrical source 16, the igniter 25 emits free electrons and the rate of emission of the electrons or amount of electrons being emitted at any one time is related to the temperature of the igniter 25 whereby this emission rate increases as the temperature of the igniter 25 increases.

Therefore, it was found according to the teachings of this invention that a receiving means or metallic plate 34 can be disposed closely adjacent the igniter 25 to collect at least some of the emitted electrons thereon when the plate 34 is electrically interconnected into the circuit 24 in a manner now to be described.

The receiving means or plate 34 can comprise a stainless steel member and have one end 35 thereof carried by an insulating terminal block 36 and which is interconnected to a lead means 37 of the circuit means 24 so that the lead means 37 is insulated from the heat being generated by the igniter 25 when the igniter is being energized to ignition temperature in the manner previously set forth.

The lead means 37 is interconnected to one side 38 of a capacitor 39 which has another side 40 thereof interconnected by a lead means 41 to a junction point 42 that is interconnected by lead means 43 and 44 respectively to sides 45 and 46 of resistors 47 and 48 that have the other sides 49 and 50 thereof respectively interconnected by lead means 51 and 52 to the lead means 29 and 30 intermediate the switch means 32 and the igniter 25 as illustrated. The intermediate point 42 is also interconnected to ground 53 by a lead means 54.

A high impedance resistor 55 is disposed in parallel with the capacitor 39 and has one side 56 thereof interconnected to the lead means 37 by a lead means 57 on the side 38 of the capacitor 39 and another side 58 thereof interconnected by a lead means 59 to the lead means 37 on the other side 40 of the capacitor 39.

In one bench test working embodiment of the igniter 25 and plate 34 of this invention, the resistor 55 is a 22 megohm resistor, the capacitor 39 is a 0.03 microfarad capacitor and the resistors 47 and 48 each comprise a 10K ohm resistor. In such working embodiment, the stainless plate extends across one side 60 of the upside-down W-shaped igniter 25 adjacent the legs 26 and 27 thereof and is spaced from that side 60 of the igniter 25 approximately 25 to 30 thousandths of an inch.

As illustrated in FIG. 1, the thermostat 31 is electrically interconnected to the control means 15 by lead means 31' and 31'' and the control means 15 is interconnected to ground 53 by a lead means 62.

Thus, it can be seen that the igniter system 10 of this invention can be formed of relatively few parts by the method of this invention to operate in a manner now to be described.

When the thermostatic means 31 demands heat, a signal is sent therefrom to the control means 15 which closes the switch 32 so as to interconnect the igniter 25 to the alternating current source 16, whereby the igniter 25 begins to heat up and emit free electrons which are collected by the plate 34. It has been found that in the one working bench test of this invention, a DC voltage will be generated at the control device 15 and when the igniter 25 is at ignition temperature thereof, the magnitude of the DC voltage at the control device 15 is approximately 10 volts. Thus, it is believed that such DC voltage signal can be utilized to operate the aforementioned electronic triggering device in the control device 15 to cause the control device 15 to interconnect the electrical power source 16 to the fuel feeding means 14 so as to operate the valve means 14 to an open condition thereof and thereby interconnect the fuel source 12 to the burner 11 which will issue therefrom and be ignited by the now heated igniter or hot surface means 25 in a manner well known in the art.

It is believed that the receiving means or plate 34 collects at least some of the electrons being emitted by the heated igniter 25 to generate such DC voltage signal to be detected by the control device 15 in much the same manner that a diode tube has a cathode which when heated emits free electrons to be collected by a plate of that diode tube as fully set forth in the aforementioned pages 472–479 of the second edition of *Basic Electronics* authored by Bernard Grob whereby these pages are also being incorporated into this disclosure by this reference thereto.

Of course, the control device 15 can be so constructed and arranged in a manner well known in the art that the control device 15 will open the switch 32 after a certain length of time so as to not only terminate operation of the igniter 25 but also to terminate the issuing of free electrons therefrom and disconnect the plate 34 from operating the control means 15. However, the control means 15 can also be so constructed and arranged that the same will continue to maintain the valve means 14 in an open condition to feed fuel to the burner means 11 as long as the thermostat 31 of the system 10 is demanding heat and will thus terminate the operation of the fuel feeding means 14 when such thermostat 31 opens and thus indicates that the burner means 11 is no longer to be operated. Thus, such thermostat 31 will cycle the burner means 11 on and off all in a manner well known in the art as fully set forth in the aforementioned Geary U.S. Pat. No. 4,809,128 whereby the system 10 of this invention will operate the igniter 25 each time the burner means 11 is to be turned on in the manner previously set forth to ignite the fuel subsequently issuing from the burner means 11. However, fuel can only each time initially issue from the burner means 11 after the igniter 25 has reached ignition temperature.

Thus, it can be seen that the fuel ignition system 10 of this invention readily determines that only when the emission rate of electrons from the heated igniter 25 and being collected by the plate 34 reaches a certain level, the igniter 25 will be at ignition temperature and such information can be utilized to control the fuel feeding valve means 14 for feeding fuel to the burner means 11 to be ignited by that igniter 25 which is now at ignition temperature whereby the fuel ignition system 10 of this invention proves that the igniter is at ignition temperature before the valve means 14 will be opened to feed fuel to the burner means 11.

In particular, it can be seen in FIG. 1 that an alternating current is being applied to the igniter 25 by the circuit means 24 and an alternating current is being applied to the igniter 25 and the member 34 by the circuit means 24 whereby through a diode effect produced by the flow of emitted electrons from the heated igniter 25 between the igniter 25 and the member 34 a pulsating D.C. voltage is being created in line 37 that is filtered by the capacitor 39 so that a non-pulsating D.C. voltage is received by the control device 15 from line 23 and the magnitude of that non-pulsating D.C. voltage is in relation to the temperature of the igniter 25, i.e., for a particular constant value A.C. voltage being applied to the igniter 25 and the member 34, the magnitude of the non-pulsating D.C. voltage received by the control device 15 increases as the temperature of the igniter 25 increases so that the control device 15 can detect when the igniter 25 reaches ignition temperature by detecting when the magnitude of the non-pulsating D.C. voltage reaches a certain value that is created only when the igniter is at ignition temperature. Of course, that certain value would be different for each different constant voltage that could be applied to the igniter 25 and the member 34.

It is to be understood that the fuel being supplied to the burner means 11 can comprise any fuel, such as natural or synthetic gas, as is well known in the art.

Therefore, it can be seen that this invention not only provides a new fuel ignition system which proves that an igniter is at ignition temperature before fuel is adapted to be directed to a fuel burner means to be ignited by that igniter but also this invention provides a new method of making such a fuel ignition system.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a method of making a fuel ignition system for a burner means comprising an igniter having opposite ends, a source of alternating current having two power source leads for being respectively electrically interconnected to said opposite ends of said igniter for heating said igniter to ignition temperature thereof whereby said igniter emits electrons therefrom in relation to the temperature thereof, feeding means for feeding fuel from a source thereof to said burner means, and detecting means for detecting the condition of said igniter and being operatively associated with said feeding means to feed fuel to said burner means only when said detecting means detects that said igniter is at ignition temperature, said detecting means comprising a member for receiving at least some of said emitted electrons, determining means operatively associated with said member for determining from the received electrons an emission rate of said electrons from said igniter, and operating means operatively associated with said determining means for operating said feeding means to feed said fuel only when the determined emission rate is at a certain level, the improvement comprising the steps of forming a lead means to have opposite ends one of which is electrically interconnected to said member and the other of which is electrically interconnected to ground, and electrically interconnecting a pair of resistors respectively to said two power source leads and to said lead means at a point thereof intermediate said ends thereof whereby said member is adapted to develop an electrical voltage that has a present magnitude that is related to the amount of emitted electrons that are being received by said member at that time.

2. A method as set forth in claim 1 and including the steps of forming said lead means to have a high impedance .resistor therein intermediate said point and said member, and electrically interconnecting opposite ends of a Capacitor respectively to said lead means on opposite sides of said high impedance resistor so as to be in parallel therewith.

3. A method as set forth in claim 2 and including the step of forming said determining means for determining said emission rate to comprise an electrical circuit means electrically interconnected to said member and which develops said electrical voltage that has a present magnitude that is related to the amount of emitted electrons that are being received by said member at that time.

4. A method as set forth in claim 3 and including the step of forming said operating means for operating said feeding means to operate said feeding means only when said magnitude of said electrical voltage reaches a certain level.

5. A method as set forth in claim 4 and including the steps of forming said electrical circuit means to have means for applying an alternating current to said igniter and said member so as to create through a diode effect between said igniter and said member a pulsating direct current voltage, and forming said electrical circuit means to have a capacitor for filtering said pulsating direct current voltage so as to create said electrical voltage as a non-pulsating direct current voltage from said pulsating direct current voltage.

6. A method as set forth in claim 11 and including the step of forming said member to comprise a metallic member.

7. A method as set forth in claim 6 and including the step of forming said igniter to comprise silicon carbide material.

8. A method as set forth in claim 7 and including the step of forming said metallic member to comprise stainless steel.

9. A method as set forth in claim 8 and including the step of forming said metallic member to comprise a flat plate.

10. A method as set forth in claim 9 and including the step of disposing said flat plate approximately 25 to 30 thousandths of an inch from said igniter.

11. A method as set forth in claim 1 and including the step of forming said pair of resistors to each have the same value.

12. A method as set forth in claim 1 and including the step of forming said pair of resistors to each be a 10K ohm resistor.

* * * * *

UNITED STATES PATENT AND TRADEMARK OFFICE

CERTIFICATE OF CORRECTION

PATENT NO. : 5,437,548

DATED : August 1, 1995

INVENTOR(S) : Jay R. Katchka

It is certified that error appears in the above-indentified patent and that said Letters Patent is hereby corrected as shown below:

Column 6, line 56, change "dance .resistor therein" to -- dance resistor therein--.

Column 7, line 17, change "claim 11" to -- claim 1 --.

Signed and Sealed this

Nineteenth Day of December, 1995

*Attest:*

Bruce Lehman

BRUCE LEHMAN

*Attesting Officer*

*Commissioner of Patents and Trademarks*